US007657208B2

(12) United States Patent
Yahagi

(10) Patent No.: US 7,657,208 B2
(45) Date of Patent: Feb. 2, 2010

(54) IMAGE FORMING APPARATUS HAVING AN AUXILIARY DRIVING MEANS WHICH TRANSMITS A RESTRICTED DRIVING FORCE TO AN IMAGE BEARING MEMBER

(75) Inventor: Takashi Yahagi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 273 days.

(21) Appl. No.: 11/754,474

(22) Filed: May 29, 2007

(65) Prior Publication Data

US 2007/0280734 A1 Dec. 6, 2007

(30) Foreign Application Priority Data

May 30, 2006 (JP) ..... 2006-150093

(51) Int. Cl.
*G03G 15/00* (2006.01)

(52) U.S. Cl. ..... 399/167

(58) Field of Classification Search ..... 399/159, 399/167, 297, 302, 308
See application file for complete search history.

(56) References Cited

U.S. PATENT DOCUMENTS 4,330,194 A * 5/1982 Murakami ..... 399/167
6,259,880 B1 * 7/2001 Jia et al. ..... 399/302 X

FOREIGN PATENT DOCUMENTS

JP 11-24350 A 1/1999
JP 2971615 B2 8/1999

* cited by examiner

*Primary Examiner*—Sandra L Brase
(74) *Attorney, Agent, or Firm*—Fitzpatrick, Cella, Harper & Scinto

(57) ABSTRACT

An image forming apparatus includes a rotatable image bearing member; an intermediate transfer member which makes contact with the image bearing member and bears a toner image transferred from the image bearing member; a first driving means which transmits driving to the intermediate transfer member; and a second driving means which transmits driving to the image bearing member when a rotating speed of the image bearing member is lower than a predetermined speed, wherein a rotating speed of the rotatable image bearing member is faster than the predetermined speed by receiving a rotating friction force from the intermediate transfer member.

7 Claims, 3 Drawing Sheets

IMAGE FORMING APPARATUS HAVING AN AUXILIARY DRIVING MEANS WHICH TRANSMITS A RESTRICTED DRIVING FORCE TO AN IMAGE BEARING MEMBER

BACKGROUND OF THE INVENTION

1. Field of the Invention

The present invention relates to an electrophotographic image forming apparatus of an electrophotographic type, such as a copying machine, a facsimile apparatus, a printer and a complex machine (hereinafter referred simply to "image forming apparatus").

2. Description of the Related Art

With an image forming apparatus in which an electrostatic latent image is formed on an electronic photosensitive drum (hereinafter referred to as "photosensitive drum") as an image bearing member and is developed using toner, a toner image is transferred on a sheet, such as recording paper, being loaded on, for example, an endless conveyance belt. Alternatively, an intermediate transfer method is available which uses a conveyance belt thereof as an intermediate transfer belt, once transfers a toner image and holds it, and then shifts the toner image to a sheet so as to transfer the toner image.

In this case, if a relative speed difference is caused between a speed of circumference of a photosensitive drum (circumferential speed) and a traveling speed of the conveyance belt, toner images are affected resulting in a decrease in image quality or deterioration of image quality after printing. As a method to eliminate a relative speed difference as mentioned, such a configuration is available in which, a torque limiter is provided to a driving portion of the transfer belt, when a slippage is caused between the photosensitive drum and the transfer belt, drum speed is caused to follow circumferential speed of the transfer belt to reduce the slippage between the transfer belt and drum (see, Japanese Patent No. 2971615). However, this configuration is designed to follow the photosensitive drum at an abnormality of a slippage occurrence.

In the meantime, such a structure is known that, for the sake of attaining high image quality, a traveling speed of the transfer belt is maintained constant, the photosensitive drum is contacted against a belt plane thereof to allow rotation dependent on frictional force. Alternatively, a drum-dedicated belt which is provided separately is directly wound around the photosensitive drum or a pulley on the same axis, the drum-dedicated belt is revolved by a driving motor commonly used for revolving the conveyance belt (transfer member belt). Namely, the image forming apparatus proposed is designed such that one driving motor is used for revolving both the drum-dedicated belt and the conveyance belt so that a relative speed difference may not be caused between the photosensitive drum and the conveyance belt (Japanese Patent Application Laid-Open No. 11-24350).

However, the drum driving structure as disclosed in Japanese Patent No. 2971615 and conventional structures of this sort have the following problems:

One problem is that, in order to prevent a speed difference due to a slippage between photosensitive drum and the conveyance belt, it is necessary to tightly contact the photosensitive drum and the conveyance belt mutually by a strong pressing force. As a result, a problem arises in that load of the driving motor becomes excessive.

Another problem is that, the lifetimes of the drum and belt are shortened due to stresses caused by strong pressure.

From the above, an object of the present invention is to provide an image forming apparatus capable of forming good images while a belt and an image bearing member are made to be driven without increasing a pressing force between an endless transfer member belt and an image bearing member.

SUMMARY OF THE INVENTION

The present invention provides an image forming apparatus in which a belt and an image bearing member could be driven by reducing a pressing force between an endless transfer member belt and the image bearing member.

The present invention also provides an image forming apparatus including:

a rotatable image bearing member;

an intermediate transfer member which makes contact with the image bearing member and bears a toner image transferred from the image bearing member;

a first driving means which transmits driving to the intermediate transfer member; and a second driving means which transmits driving to the image bearing member when rotating speed of the image bearing member is lower than a predetermined speed;

wherein the rotatable image bearing member rotates faster than the predetermined speed by receiving rotating friction force from the intermediate transfer member.

Still another objects of the present invention will become apparent from the following description:

DESCRIPTION OF THE EMBODIMENTS

Figure 1:
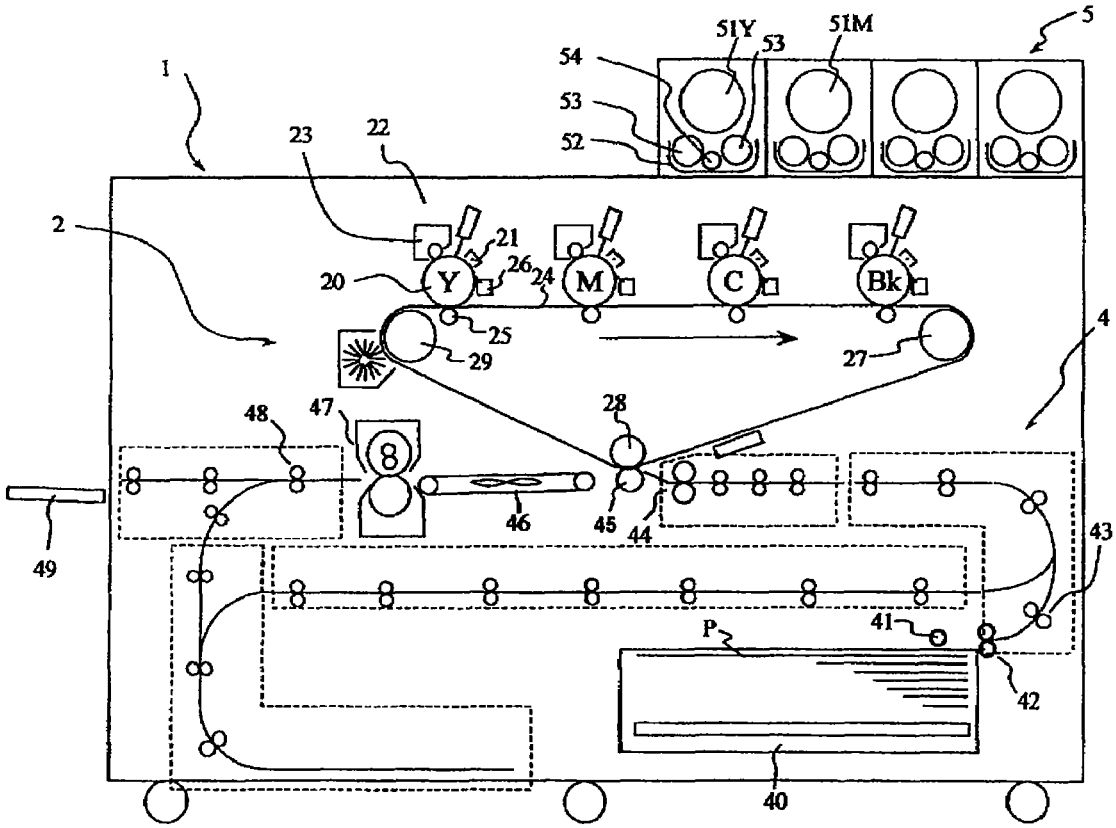
FIG. 1 is a drawing illustrating a printer body as an embodiment of the image forming apparatus according to the present invention.

Now referring to the drawings, one preferable embodiment of the image forming apparatus according to the present invention will be described hereafter in detail. It is to be understood that the present invention is not limited by to the following configurations.

FIG. 1 illustrates a printer as a detailed example of the image forming apparatus. An image forming portion 2 is provided at an upper portion in a printer body 1 and a sheet conveyance portion 4 is provided at a lower portion therein. To the image forming portion 2 are disposed photosensitive drums 20 in tandem to form at each of stations for colors, for example, Y (yellow), M (magenta), C (cyan), K (black), as individual rotatable image bearing members.

Next a process unit that acts on the photosensitive drums 20 is disposed around photosensitive drums 20 corresponding to each of colors. Each of the photosensitive drums 20 has a charger 21 for charging a drum surface uniformly by applying a charging bias voltage, and has an LED unit 22 for forming an electrostatic latent image on the photosensitive drum. It also has a development device 23 for developing the electrostatic latent image on the photosensitive drum 20 to a toner image using toners having a particle diameter from 5 to 10 μm.

It also has a primary transfer roller 25 as the primary transfer member for transferring a toner image on the photosensitive drum 20 to an intermediate transfer belt as the intermediate transfer member, and a cleaner 26 for removing toner remained on the photosensitive drum 20 by scraping it off by a blade. The intermediate transfer belt 24 is tensioned while being wound between each of rollers of driving roller 27, roller 28 and tension roller 29.

In the sheet conveyance portion 4, sheets P, such as recording materials, accommodated in a sheet cassette 40 are separated one by one by a sheet feeding roller 41 and by a pair of opposed separation rollers 42, and are conveyed to a pair of opposed registration rollers 44 by conveyance rollers 43 disposed at a plurality of locations along with the conveyance path. A sheet P having reached the registration roller 44 is conveyed to a position of the toner image on the intermediate transfer belt 24 keeping good timing.

The toner image on the intermediate transfer belt 24 is transferred on the sheet P by a second transfer roller 45 as the secondary transfer member. A conveyance belt 46 for conveying the sheet P and a fixing apparatus 47 for fixing the toner image to the sheet P are disposed at downstream of the secondary transfer outer roller 45. A sheet feeding roller 48 for discharging the sheet P onto which the toner image is fixed outside the printer body 1, and a discharge tray 49 for loading and accommodating the sheet P thus discharged are provided.

First Embodiment

Drum Auxiliary Rotating Mechanism

Figure 2:
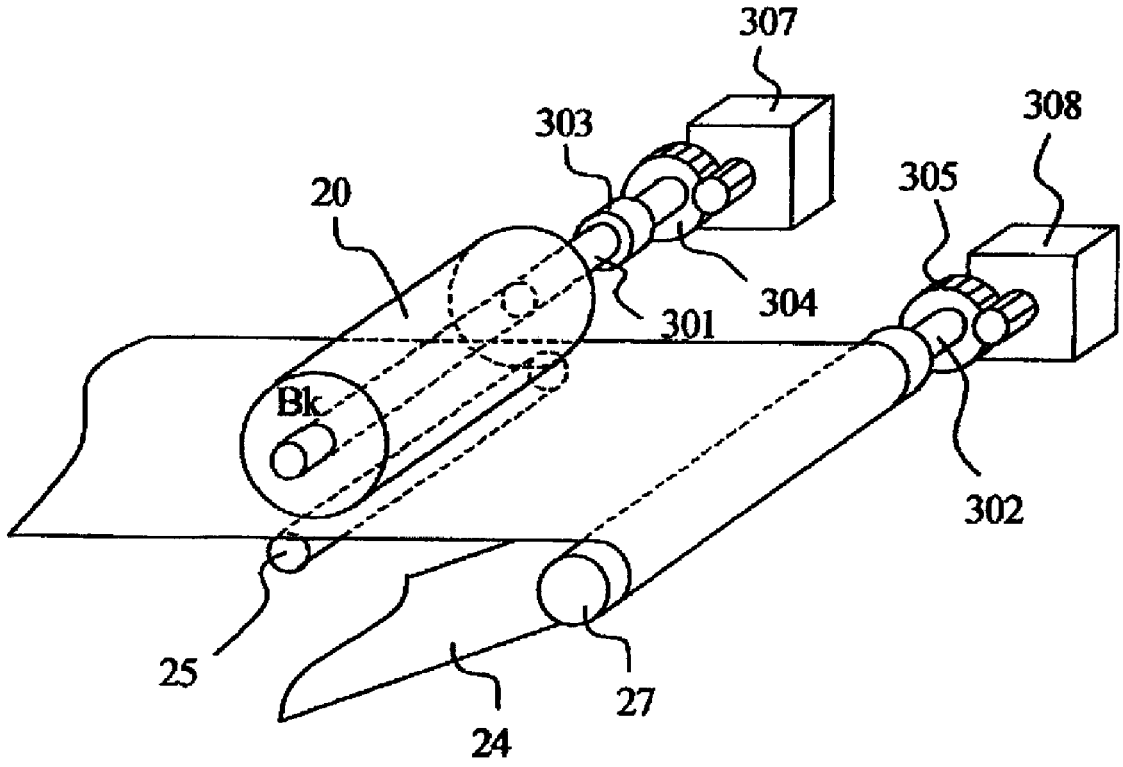
FIG. 2 is a perspective view illustrating the main parts of a drum rotating mechanism according to a first embodiment.

FIG. 2 illustrates a first embodiment of a "drum auxiliary rotating mechanism" relating to rotary driving of a photosensitive drum 20 which is the gist of the present invention.

The primary transfer roller 25 for pressing the intermediate transfer belt 24 from rear side to pushing it against the photosensitive drum 20 to cause close contact is provided. The primary transfer roller 25 is pushed by an elastic force by a compression spring (not shown) together with bearings at both ends of the roller and are biased in the direction being pressed against the intermediate transfer belt 24 by a spring force of, for example, about 35 [N].

One end of the intermediate transfer belt 24 is wound around the driving roller 27. A driving gear 305 is provided to one end of a roller shaft 302 that is a rotating shaft of the driving roller 27. To this driving gear 305 is coupled by meshing an output shaft gear of a belt driving motor (first driving means) 308 that acts as the driving means.

Namely, the driving roller 27 rotates upon receiving a rotating power being output from the belt driving motor 308 to cause the intermediate transfer belt 24 to revolve. Since the intermediate transfer belt 24 is pressed against the photosensitive drum 20 by the above-mentioned primary transfer roller 25, the photosensitive drum 20 rotates in a driven manner upon receiving a rotating frictional force from the intermediate transfer belt 24. An ordinary drum mechanism for rotating the photosensitive drum 20 as mentioned is referred to as a "drum driven mechanism" for convenience of illustration of the drum auxiliary rotating mechanism.

In order to reduce a pressure by the photosensitive drum 20 and the intermediate 24 transfer belt in the drum driven mechanism, a drum auxiliary rotating mechanism which assists rotation of the photosensitive drum 20 is provided.

The photosensitive drums 20 corresponding to each of Y, M, C, K colors are supported rotatably via a drum shaft 301, respectively. A torque limiter (driving restrictive means) 303 is connected to one end of such drum shaft 301, and it is connected to a drum driving gear 304 via the torque limiter 303. The drum driving gear 304 meshes with an output shaft gear of a drum driving motor (second driving means) 307 and the photosensitive drum 20 rotates at a predetermined rotating speed while motor rotating power is received by the drum driving gear 304. In order to allow the photosensitive drum to perform rotation dependent on rotation of the intermediate transfer belt, the torque limiter 303 functions as follows.

First, torque T(D) required to rotate the photosensitive drums 20 is calculated as follows:

It is supposed that the intermediate transfer belt 24 is not pressed by the primary transfer roller 25 from the rear side, and therefore, the photosensitive drum 20 does not receive a rotating frictional force from the intermediate transfer belt 24. This value is equivalent to a value in a state that the intermediate transfer belt is spaced apart from the photosensitive drum. A torque needed to rotate the photosensitive drum 20 in this state is defined to be T(D).

Further, a torque needed to rotate the photosensitive drum 20 when a predetermined amount of toner (residual toner) in present on the photosensitive drum 20 in the state that the intermediate transfer belt 24 is spaced apart from the photosensitive drum, is defined to be T(D').

Meanwhile, with the above-mentioned configuration, when pressed by the primary transfer roller 25 and an electrostatic coherent force is generated by applying a high-voltage as for the primary transfer, a torque applied from the intermediate transfer belt 24 to the photosensitive drum 20 in a state that the electrostatic coherent force is being generated, is defined as T(B). The high-voltage used on this occasion is a voltage when an image is formed onto plain paper.

If a driving transmission torque (limit torque) by the torque limiter 303, where rotation of the drum is subjected to limitation of driving by driving means, is defined as T(L), T(D) is then a torque required for rotating the drum, T(B)+T(L) is a driving force to rotate the drum, and therefore, it should be greater than T(L), and the following Equation (1) is established.

$$0<T(L)<T(D')<T(D)<T(B)+T(L) \quad (1)$$

Driving transmission torque T(L) of the torque limiter 303 is then set so that Equation (1) may be established. Torque T(B) is normally changed depending on a high voltage for primary transfer, a bias force, and an amount of toner existing at a nip portion between the intermediate transfer belt 24 and photosensitive drum 20.

The method of measurements of T(B), T(D) devised by the inventors is as follows. For T(B), a high voltage for primary transfer that assumes the minimum value (voltage used to transfer a toner image at image formation) and a bias force (bias force with regard to photosensitive drum of the primary transfer roller) are set to the lower limit thereof, and a state where a maximum amount of toner is loaded to the nip portion is generated. In this state, revolving traveling of the intermediate transfer belt 24 is stopped and a torque when the photosensitive drum 20 starts slippage by rotation is measured.

A state where a maximum amount of toner is loaded to the nip portion denotes a maximum color density. And with a multicolor machine, the state denotes a maximum amount of superimposition. In this case, the cleaner 26 and others which may resist to rotation of the photosensitive drum 20 should be removed and kept away.

In the meantime, measurement of T(D) is carried out in such a state that the cleaner 26 is mounted and toners on the photosensitive drum 20 are scraped off so that T(D) may attain the maximum value.

T(D') is also measured in the state that residual toner is still present on the photosensitive drum 20.

In the present embodiment, a maximum amount of toner at the nip portion of the photosensitive drum 20 was 1.45 [mg/cm$^2$] and residual toner were 0.06 [mg/cm$^2$].

The results of actual measurement were T(B) was 0.37 [N·m], T(D) was 0.28 [N·m], T(D') was 0.27 [N·m]. As for the torque limiter 303, one with a driving transmission torque T(L) of 0.24 [N·m] was used. When measurement values, T(B)=0.37 [N·m] and T(D)=0.28 [N·m], are substituted into Equation (1), the inequality expression is satisfied even if T(L) is set to [0]. However, T(D) and T(B) vary at the time of actual image generation. Accordingly, it is preferable to set the driving transmission torque T(L) at a higher level as long as conditions of Equation (1) are met.

As mentioned above, the drum auxiliary rotating mechanism assists rotary driving force via the torque limiter 303 in the form of auxiliary rotating torque with regard to the photosensitive drum 20, and hence the photosensitive drum 20 and the intermediate transfer belt 24 can rotate without causing a slippage therebetween while synchronizing their surface speed even when T(B) is small.

In the first embodiment, when the torque limiter 303 was not provided, occurrence of a slippage was noticed between the photosensitive drum 20 and intermediate transfer belt 24, even if pressing force by the primary transfer roller 25 was increased to 85 [N].

In the meantime, installation of the drum auxiliary rotating mechanism including the drum driving motor 307 and torque limiter 303 results in that no slippage occurs between the photosensitive drum 20 and the intermediate transfer belt 24 if the pressing force of the primary transfer roller 25 is set to 18 [N]. As a result, favorable images could be obtained.

In this respect, when driving transmission torque T(L) was set to 0.4 [N·m] which apparently did not satisfy the condition of Equation (1), images obtained revealed banding attributable to gear pitch of the drum driving gear 304 and roller driving gear 305. This is because since torque T(L) was set to 0.4 [N·m], T(L)<T(D')<T(D) of previously-mentioned inequality expression was no longer met, and driving via the torque limiter 303 and a driving force by the intermediate transfer belt 24 influenced each other, thereby causing vibrations to each driving train.

Meanwhile, a rotating speed of the drum driving motor 307 and the belt driving motor 308 is set as follows.

When the photosensitive drum 20 is rotated by the drum driven mechanism by receiving a rotating frictional force from the intermediate transfer belt 24, angular velocity is defined to be ω(B).

Further, the photosensitive drum 20 is rotated in the state that rotating transmission torque T(L) is not received from the torque limiter 303 and the drum shaft 301 carries almost no load. If angular velocity on this occasion is defined to be ω(L), the following Equation (2) is established:

$$\omega(B)<\omega(L) \tag{2}$$

In the first embodiment, in order to establish Equation (2), ω(L) is set to 0.924 [rad/s] which is 1.05 times of ω(B)=0.88 [rad/s]. Namely a rotating speed of the photosensitive drum 20 by rotating power from the drum driving motor 307 via the torque limiter 303 is set faster than rotating speed received from the intermediate transfer belt 24 by rotating frictional force. As a result, rotary driving of the photosensitive drum 20 is assisted all the time.

An angular speed ω(L) of the drum auxiliary rotating mechanism by the drum driving motor 307 and the torque limiter 303 is preferably set in the range greater than angular velocity ω(B) of the drum driven mechanism by the belt driving motor 308 and intermediate transfer belt 24, and less than or equal to 1.2 times. As long as rotation of the photosensitive drum 20 is assisted, the angular velocity more than or equal to one time is enough.

However, in reality, fluctuation of a rotating speed of the driving motor, an error or fluctuation of accuracy of processing of drum diameter of the photosensitive drum 20, an irregularity of thickness of the intermediate transfer belt 24, an error or fluctuation of accuracy of processing of roller diameter of the driving roller 27 should be considered. It is probable that ω(B) and ω(L) vary slightly due to these accuracy errors.

When angular velocity ω(L) is considered to be equal to ω(B), there is a possibility that, although temporal, speed of the photosensitive drum 20 surface is slower than speed of the intermediate transfer belt 24. Therefore, it is preferably more than or equal to 1%, namely, more than or equal to 1.01 times, so that the speed may not be reversed even in a case where circumferential speed of the photosensitive drum 20 surface and a traveling speed of the intermediate transfer belt 24 are slightly changed.

In the meantime, to set the angular velocity ω(L) to an extremely faster level by the drum auxiliary rotating mechanism including the torque limiter 303 results in an increased relative speed difference between the intermediate transfer belt 24 and the drum driven mechanism side. If so attempted, a greater load is naturally applied to the torque limiter 303 though speed inversion phenomenon does not occur, resulting disadvantageously in shortened durability (lifetime) of the torque limiter 303 itself. Therefore a relative speed difference between ω(B) and ω(L) is preferably set to less than or equal to 20%, namely, ω(L) be set to less than or equal to 1.2 times of ω(B).

Second Embodiment

Drum Auxiliary Rotating Mechanism

Figure 3:
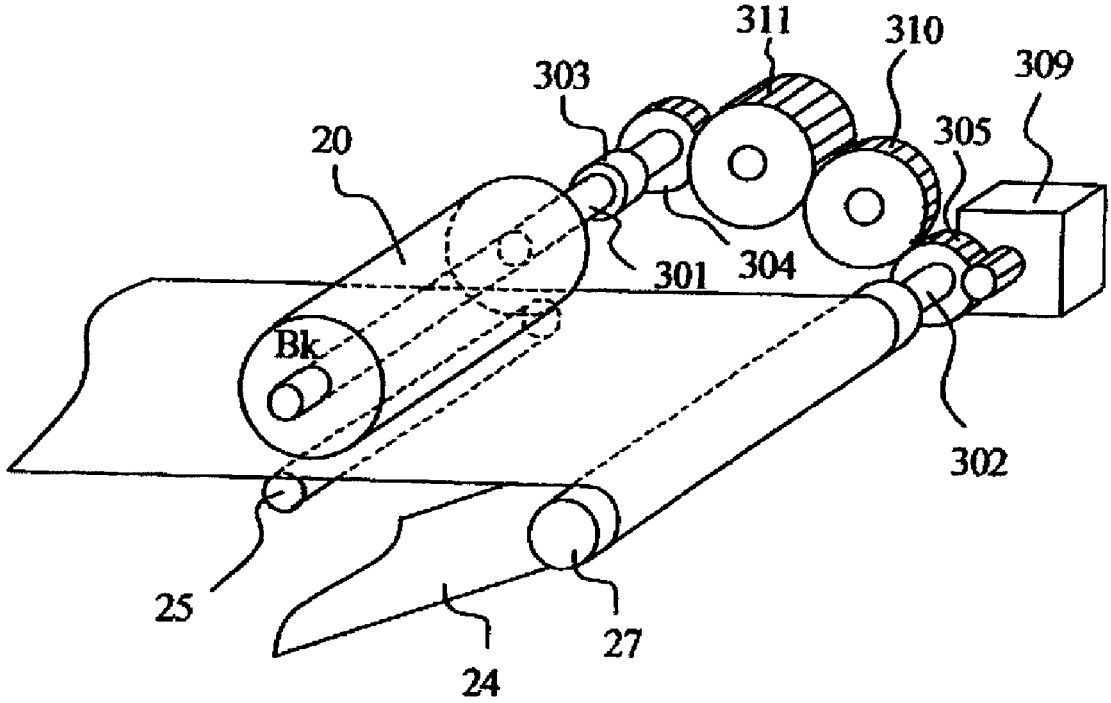
FIG. 3 is a perspective view illustrating the main parts of the drum rotating mechanism according to a second embodiment.

FIG. 3 illustrates a second embodiment. Members and equipment which are the same as or similar to those shown in the above-mentioned first embodiment are denoted by like reference numerals, and descriptions are not repeated.

In the drum driven mechanism, the driving roller 27 for driving the intermediate transfer belt 24 is coupled by meshing with an output shaft gear of a motor for driving both belt and drum (hereinafter referred to as a "common use motor") via the driving gear 305 provided to one end of the roller shaft 302. The driving gear 305 also meshes with an idler gear 310 and is connected to the drum auxiliary rotating mechanism side which will be shown below via an idler gear 311 similarly.

In the drum auxiliary rotating mechanism, the torque limiter 303 is connected to one end of the drum shaft 301 of the photosensitive drum 20, and the driving gear 304 is provided via this torque limited 303. The driving gear 304 meshes with the idler gear 311 and is connected to the drum driven mechanism including the intermediate transfer belt 24

In other words, the second embodiment differs from the first embodiment in that both members of the intermediate transfer belt 24 and photosensitive drum 20 receive rotating power from the above-mentioned one common use motor 309, and the torque limiter 303 is caused to intervene between the drum driven mechanism and drum auxiliary rotating mechanism.

Since rotary driving is carried out by one common use motor 309, only turning ON/OFF of driving of one common use motor 309 enables synchronization and simultaneous rotation of the photosensitive drum 20 and intermediate transfer belt 24. When, as is the case of the first embodiment, the photosensitive drum 20 and intermediate transfer belt 24 are rotated independently by dedicated driving motors 307, 308, it is probable that a time difference is caused at starting and stopping between both members. For example, due to an ON/OFF time difference the intermediate transfer belt 24 is operated prior to starting of auxiliary driving of the photosensitive drum 20, and the photosensitive drum 20 and the intermediate transfer belt 24 may mutually cause a slippage. As a result, a surface of the photosensitive drum 20 and the intermediate transfer belt 24 is damaged, thereby affecting image quality.

These drawbacks are eliminated in the present embodiment. Controls of the driving motor for synchronization with high accuracy at starting and stopping, controls of a starting ON/OFF order of the drum driving motor 307 and belt driving motor 308 as exemplified in the first embodiment are unnecessary.

The image forming apparatus according to the present invention is described by the first and second embodiments as mentioned above. The present invention is not limited to each of embodiments, and other embodiments, applications, modifications and combination thereof are possible without departing from scope of the present invention.

For example, in the first embodiment, although the torque limiter 303 is provided on the same shaft of the drum shaft 302 of the photosensitive drum 20, the present invention is not limited to this configuration, and the torque limiter 303 may be disposed appropriately at any suitable location of the drum auxiliary rotating mechanism.

Further, it is possible to use a cylindrical intermediate transfer member drum in place of the intermediate transfer belt 24, or may be substituted by a conveyance transfer belt for conveying the sheet P.

Although a printer having such a configuration that four photosensitive drums 20 are disposed in tandem form corresponding to each of colors Y, M, C, K is exemplified, the photosensitive drum 20 may correspond to colors other than four colors, namely, a single color or two colors, and is not limited to the number of installations of four photosensitive drums.

Further, although an LED unit is exemplified as a unit for forming an electrostatic latent image to the photosensitive drum 20, such one for forming a desired electrostatic latent image by manipulating laser light by rotation of a rotary polygon mirror may be used, and the unit is not limited thereto.

According to the second embodiment, although the drum driven mechanism, such as intermediate transfer belt 24, and the drum auxiliary rotating mechanism, such as photosensitive drum 20, are connected via a gear train such as idler gears 310, 311, timing belt may be used in place of the gear train.

Further, to be used commonly for the first and second embodiments, it may be configured in such that speed detection sensors for detecting a rotating speed and a traveling speed of the photosensitive drum 20 and the transfer member belt 24 are disposed in place, and a latent image is formed on the photosensitive drum 20 through controls based on these detection signals.

In the present invention, although a torque limiter is used as the driving transmission restrictive means, a configuration using a gear (one-way gear) for transmitting driving in one rotation direction can produce the same effects.

According to the image forming apparatus of the present invention, rotation of the photosensitive drum dependent on rotating frictional force with the transfer member belt is assisted by the drum auxiliary rotating mechanism. Therefore, the transfer member belt and photosensitive drum can be driven at the same speed all the time so that speed difference due to a slippage may not be caused between both members, thereby forming high-quality images.

Further, the transfer member belt and photosensitive drum may not be pressed strongly from each other for the sake of elimination of a speed difference, an upgrading of strength and rigidity of both belt and drum materials is not required, and this is effective for cost reduction and suppression of increased dimensions of members.

Although embodiments of the present invention are described, the present invention is not limited to any degree by the above-mentioned embodiments, and various modifications are possible within the technical spirit of the present invention.

This application claims the benefit of priority from the prior Japanese Patent Application No. 2006-150093 filed on May 30, 2006 the entire contents of which are incorporated by reference herein.

What is claimed is:

1. The image forming apparatus comprising:

a rotatable image bearing member;

an intermediate transfer member which makes contact with the image bearing member and bears a toner image transferred from the image bearing member;

a first driving means which transmits a driving force to the intermediate transfer member; and a second driving means which transmits a driving force to the image bearing member when a rotating speed of the image bearing member is lower than a predetermined speed, wherein a rotating speed of the rotatable image bearing member is faster than the predetermined speed by receiving a rotating friction force from the intermediate transfer member, wherein the second driving means includes a motor and a driving restrictive unit for restricting transmission of a driving force from the motor to the image bearing member, and wherein a relationship between torque T(L) for restricting transmission of the driving force from the second driving means to the image bearing member and a torque T(D) necessary for rotation of the image bearing member in a state that the image bearing member is not contacted with the intermediate transfer member, satisfies the following relationship:

$$0<T(L)<T(D).$$

2. The image forming apparatus as set forth in claim 1, wherein the image forming apparatus includes a primary transfer member for transferring a toner image borne on the image bearing member to the intermediate transfer member, and wherein a torque T(B) applied from the intermediate transfer member to the image bearing member when a voltage necessary for transferring the toner image is applied to the primary transfer member, in a state that the image bearing member and the intermediate transfer member are contacted and driven by the first driving means, satisfies the following relationship:

$$T(D)<T(B)+T(L).$$

3. The image forming apparatus as set forth in claim 1, wherein a torque T(D') necessary for the secondary driving means to rotate the image bearing member when the image bearing member bears a toner image, satisfies the following relationship:

$$0<T(L)<T(D')<T(D).$$

4. An image forming apparatus comprising:

a rotatable image bearing member;

an intermediate transfer member which makes contact with the image bearing member and bears a toner image transferred from the image bearing member;

a first driving means which drives the intermediate transfer member; and a second driving means which transmits a driving force to the image bearing member, wherein the image bearing member is capable of rotating upon receiving a driving force from the intermediate transfer member, and wherein a relationship between a torque T(L) for restricting transmission of the driving force from the second driving means to the image bearing member, and torque T(D) necessary for rotating the image bearing member without causing contact with the intermediate transfer member, satisfies the following relationship:

$$0<T(L)<T(D).$$

5. The image forming apparatus comprising:

a rotatable image bearing member;

an intermediate transfer member which makes contact with the image bearing member and bears a toner image transferred from the image bearing member;

a first driving means which transmits a driving force to the intermediate transfer member; and a second driving means which transmits a driving force to the image bearing member when a rotating speed of the image bearing member is lower than a predetermined speed, wherein a rotating speed of the rotatable image bearing member is faster than the predetermined speed by receiving a rotating friction force from the intermediate transfer member;

a primary transfer member for transferring a toner image borne on the image bearing member to the intermediate transfer member, and wherein a torque T(B) applied from the intermediate transfer member to the image bearing member when a voltage necessary for transferring the toner image is applied to the primary transfer member, in a state that the image bearing member and the intermediate transfer member are contacted and driven by the first driving means, satisfies the following relationship:

$$T(D)<T(B)+T(L).$$

6. The image forming apparatus as set forth in claim 5, wherein a torque T(D') necessary for the primary driving member to rotate the image bearing member when the image bearing member bears a toner image, satisfies the following relationship:

$$0<T(L)<T(D')<T(D).$$

7. The image forming apparatus as set forth in claim 5, wherein a first rotating speed of the image bearing member driven by the second driving means is faster than a second rotating speed of the image bearing member driven by the intermediate transfer member.

* * * * *